US008413459B2

(12) United States Patent
Kim et al.

(10) Patent No.: US 8,413,459 B2
(45) Date of Patent: Apr. 9, 2013

(54) REFRIGERATOR

(75) Inventors: Dong-hwa Kim, Gwangju (KR); Seung-tae Lim, Gwangju (KR); Sun-gyou Lee, Gwangju (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 715 days.

(21) Appl. No.: 12/588,046

(22) Filed: Oct. 1, 2009

(65) Prior Publication Data

US 2010/0083685 A1 Apr. 8, 2010

(30) Foreign Application Priority Data

Oct. 2, 2008 (KR) ..... 10-2008-0097239

(51) Int. Cl.
*F25C 1/00* (2006.01)

(52) U.S. Cl.
USPC ..... 62/347

(58) Field of Classification Search ..... 62/340, 62/347, 389
See application file for complete search history.

(56) References Cited

U.S. PATENT DOCUMENTS

| | | | | | |
|---|---|---|---|---|---|
| 3,012,417 | A | * | 12/1961 | Harle | 62/347 |
| 6,157,777 | A | * | 12/2000 | Banks et al. | 392/480 |
| 2003/0046949 | A1 | * | 3/2003 | An et al. | 62/353 |

FOREIGN PATENT DOCUMENTS

| | | | |
|---|---|---|---|
| JP | 09-105572 | | 4/1997 |
| KR | 10-1999-0036554 | | 5/1999 |
| KR | 10-2002-0051987 | | 7/2002 |
| KR | 10-2008-0025237 | * | 3/2008 |

* cited by examiner

*Primary Examiner* — Melvin Jones
(74) *Attorney, Agent, or Firm* — Staas & Halsey LLP

(57) ABSTRACT

Disclosed is a refrigerator including a main body cabinet forming a storage compartment with a front opening, a door opening and closing the front opening of the storage compartment, and an ice making tray mounted to the door and making ice. The refrigerator includes a water supplying pipe which receives water from a water supplying source; a discharging pipe guide which includes a hollow part and is mounted to a through part penetrating from an outside region of the door to an upper side of the ice making tray; and a discharging pipe which includes a first end detachably connected to the water supplying pipe, and a second end disposed above the ice making tray after passing through the hollow part and detachably coupled to the door.

11 Claims, 5 Drawing Sheets

REFRIGERATOR

CROSS-REFERENCE TO RELATED APPLICATIONS

This application claims priority from Korean Patent Application No. 10-2008-0097239, filed on Oct. 2, 2008 in the Korean Intellectual Property Office, the disclosure of which is incorporated herein by reference.

BACKGROUND

1. Field

The present invention generally relates to a refrigerator, and more particularly, to a refrigerator of which a discharging pipe to supply water to an ice making tray is replaceable without replacing a door.

2. Description of the Related Art

In general, a refrigerator includes a main body cabinet formed with a storage compartment, a door to open and close the storage compartment, and an ice making tray placed in the storage compartment and making ice.

The main body cabinet includes an inner shell and an outer shell spaced apart from each other with a heat insulating material filled therebetween, and the door includes a door inner plate and a door outer plate spaced apart from each other with the heat insulating material filled therebetween.

There has recently been developed a refrigerator provided with a water supplying system capable of automatically supplying water to an ice making tray. Such a refrigerator includes a water supplying pipe receiving water from an external water supplying source or an internal water supplying tank provided in the storage compartment and supplying the water to the ice making tray. Further, a heater winds around an outer surface of the water supplying pipe in order to prevent water remaining in the water supplying pipe from freezing when the water supply is discontinued. Here, the water supplying pipe with the heater has a structure to pass through a foaming space of the heat insulating material in the main body cabinet or through a foaming space of the heat insulating material in the door. The water supplying pipe is embedded in and fastened to the heat insulating material filled in the foaming space of the heat insulating material.

However, such a conventional refrigerator has a problem that the whole door has to be replaced when the water supplying pipe needs to be replaced due to a heater trouble, etc. since the water supplying pipe is not independently separated from the door.

SUMMARY

Accordingly, an aspect of the present invention is to provide a refrigerator of which a discharging pipe to supply water to an ice making tray is replaceable without replacing a door.

Additional aspects and/or advantages will be set forth in part in the description which follows and, in part, will be apparent from the description, or may be learned by practice of the invention.

The foregoing and/or other aspects of the present invention can be achieved by providing a refrigerator including a main body cabinet forming a storage compartment with a front opening, a door opening and closing the front opening of the storage compartment, and an ice making tray mounted to the door and making ice, the refrigerator including: a water supplying pipe which receives water from a water supplying source; a discharging pipe guide which includes a hollow part and is mounted to a through part penetrating from an outside region of the door to an upside of the ice making tray; and a discharging pipe which includes a first end detachably connected to the water supplying pipe, and a second end disposed above the ice making tray after passing through the hollow part and detachably coupled to the door.

The discharging pipe guide may be inclined down toward the upper side of the ice making tray.

The door may include a door inner plate and a door outer plate spaced apart from each other with a space to be filled with a heat insulating material; and a pipe installation part forming a space where the water supplying pipe and the discharging pipe are installed in an upper region of the door inner plate and a door outer plate.

The discharging pipe may be detachably coupled to the pipe installation part.

The discharging pipe may have a larger inner diameter than the water supplying pipe.

The discharging pipe may include an inlet disposed horizontally and connected to the water supplying pipe; and an outlet bent and extended from the inlet and inserted in the hollow part of the discharging pipe guide.

The discharging pipe may include a supporting part to support the inlet and the outlet to the door.

The outlet may have a larger inner diameter than the inlet.

The refrigerator may further include a heater supplying heat to the discharging pipe.

The foregoing and/or other aspects of the present invention are achieved by providing a refrigerator including a main body cabinet forming a storage compartment, and an ice making tray mounted to the storage compartment and making ice, the refrigerator including: a water supplying pipe which receives water from a water supplying source; a discharging pipe guide which includes a hollow part and is mounted to a through part penetrating from an outside region of the main body cabinet to an upside of the ice making tray; and a discharging pipe which includes a first end detachably connected to the water supplying pipe, and a second end disposed above the ice making tray after passing through the hollow part and detachably coupled to the main body cabinet.

BRIEF DESCRIPTION OF THE DRAWINGS

The above and/or other aspects of the present invention will become apparent and more readily appreciated from the following description of the exemplary embodiments, taken in conjunction with the accompanying drawings, in which.

DETAILED DESCRIPTION OF EMBODIMENTS

Figure 1:
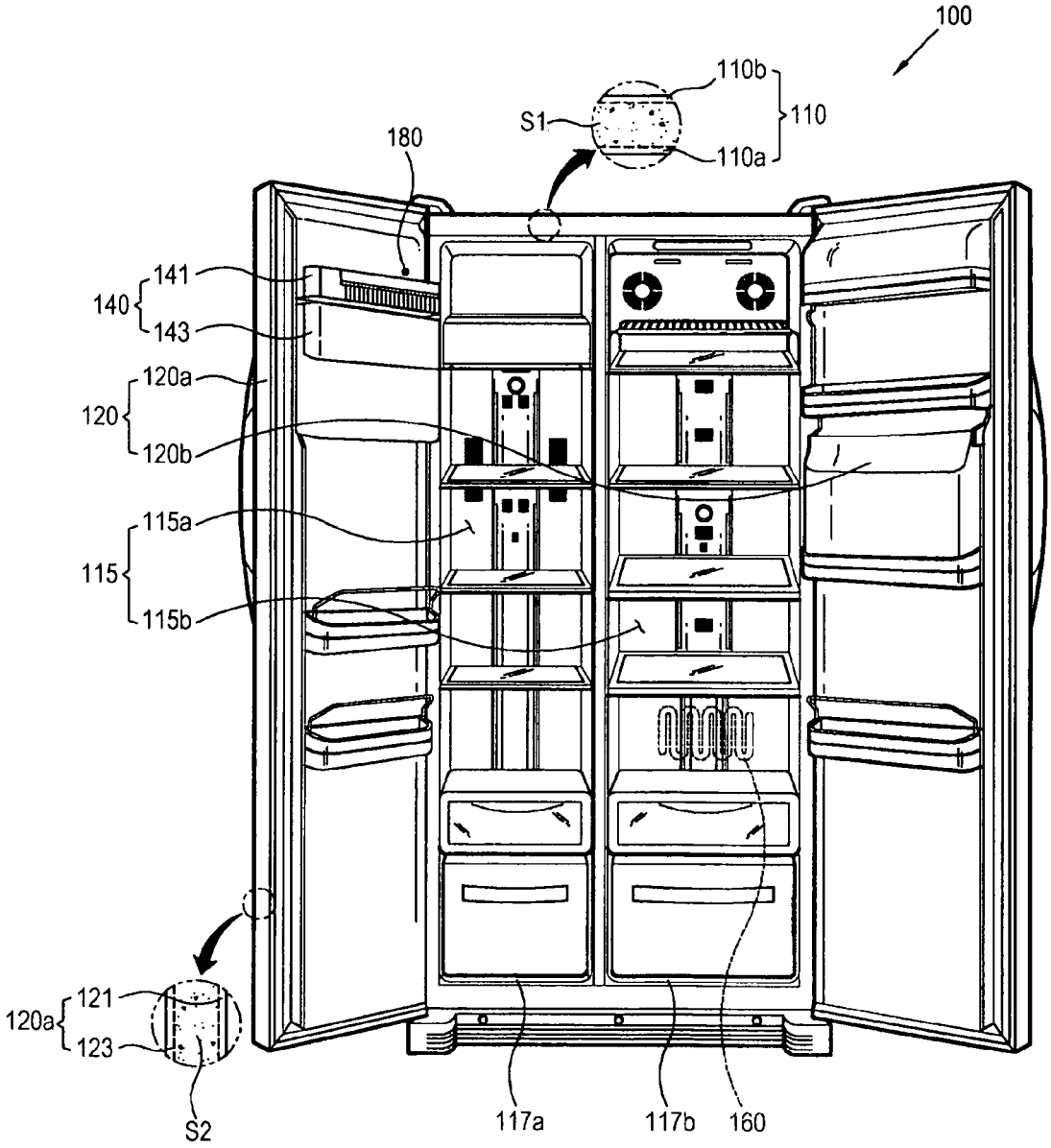
FIG. 1 is a font view showing a schematic configuration of a refrigerator according to a first exemplary embodiment of the present invention.
Figure 2:
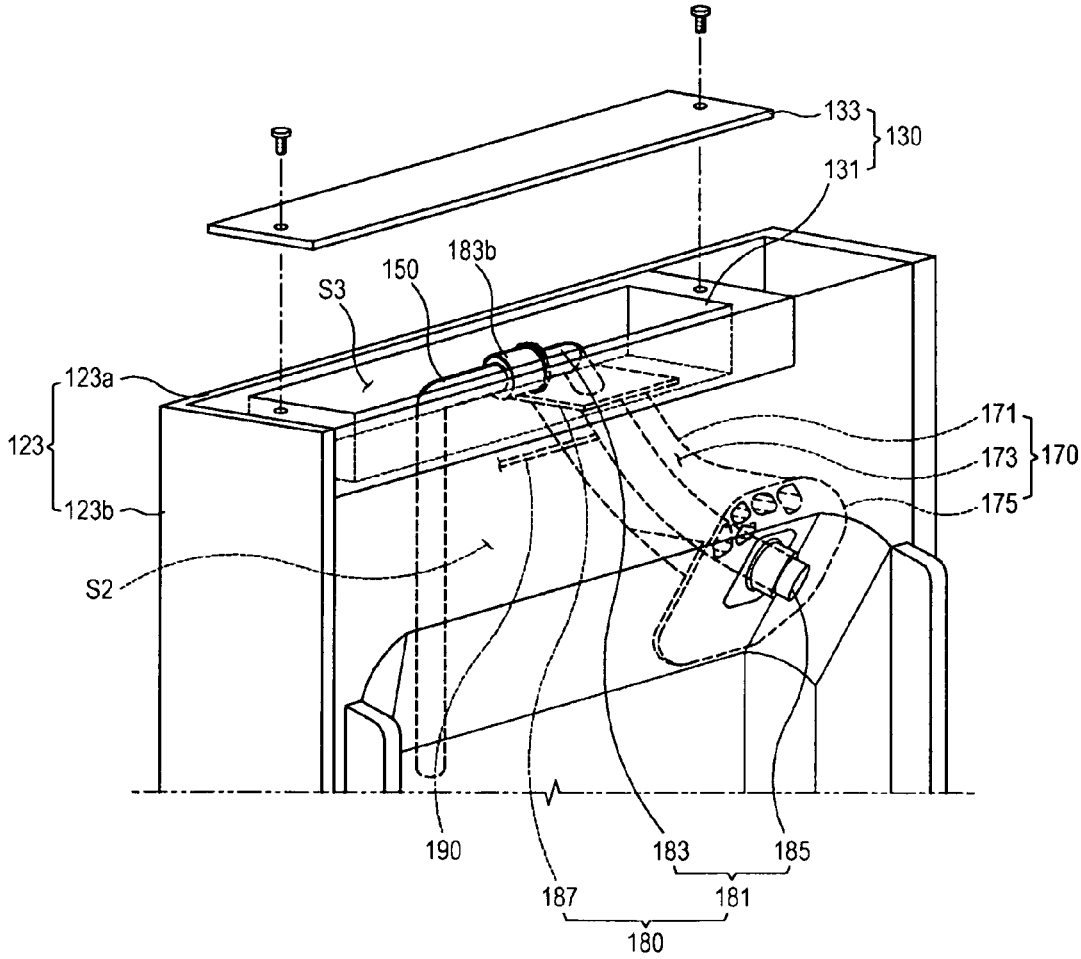
FIG. 2 is a view showing a configuration of the refrigerator according to the first exemplary embodiment of the present invention.
Figure 3:
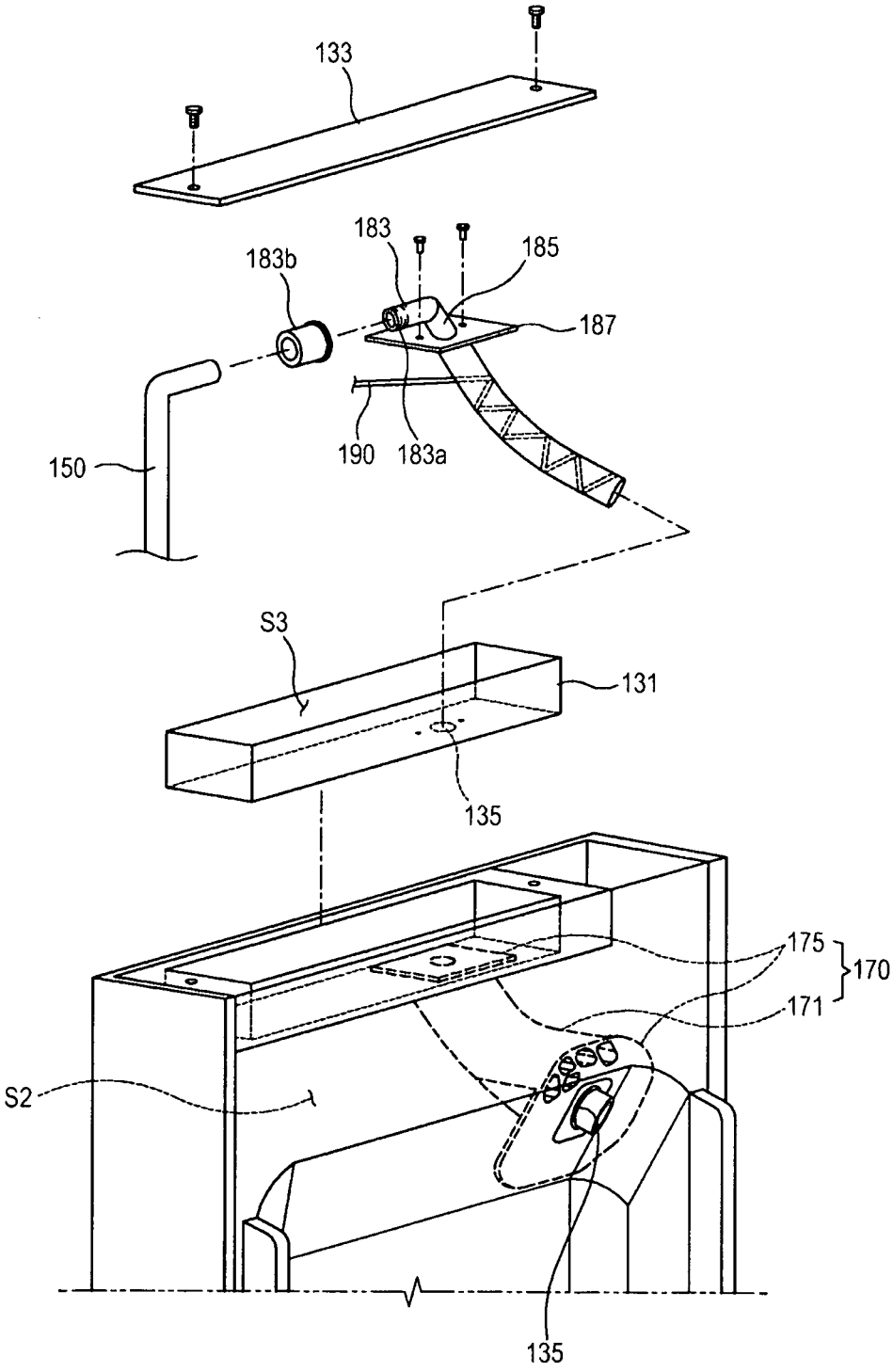
FIG. 3 is an exploded perspective view of FIG. 2.
Figure 4:
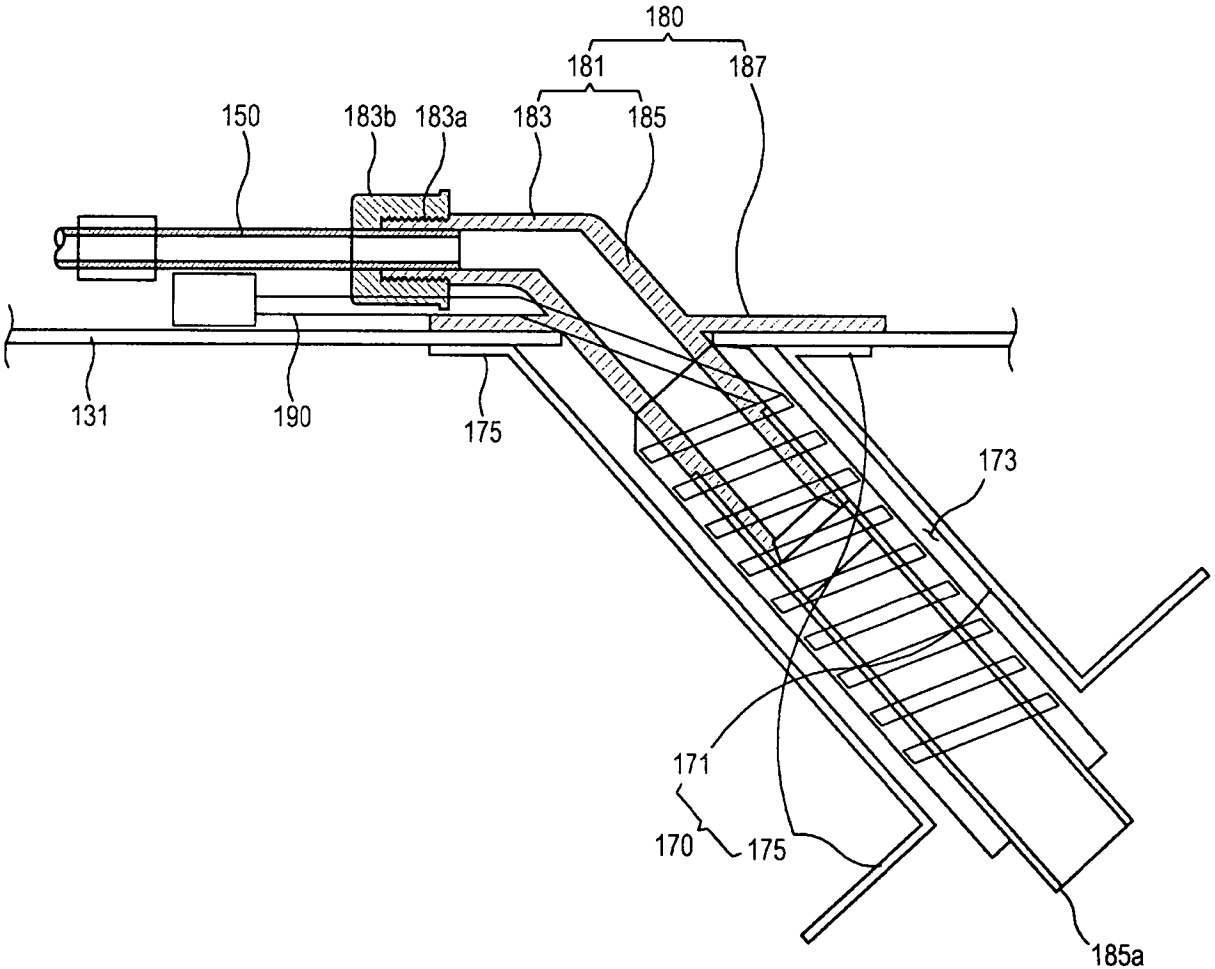
FIG. 4 is a section view of a water supplying pipe and a discharging pipe taken along lengthwise directions thereof in order to show the assembled major configuration of the refrigerator according to the first exemplary embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

Referring to FIGS. 1 to 4, a refrigerator 100 according to a first exemplary embodiment of the present invention will be described.

In this embodiment, the refrigerator 100 includes a main body cabinet 110 forming a storage compartment 115, a door 120 opening and closing front openings 117*a* and 117*b* of the storage compartment 115, an ice making tray 141 mounted to the door 120 and making ice, a water supplying pipe 150 receiving water from a water supplying source 160, a discharging pipe guide 170 mounted to a through part 135 and disposed from the outside of the door 120 to an upside of the ice making tray 141, and a discharging pipe 180 having a first end detachably coupled to the water supplying pipe 150 and a second end disposed above the ice making tray 141 after passing through a hollow part 173 of the discharging pipe guide 170 and detectably coupled to the door 120.

The main cabinet 110 includes an inner shell 110*a* forming the storage compartment 115 formed with the front openings 117*a* and 117*b*, and an outer shell 110*b* spaced apart from the inner shell 110*a* with a space S1 to be filled with a heat insulating material therebetween and forming an outer appearance.

The storage compartment 115 includes a freezer compartment 115*a* and a refrigerator compartment 115*b* which are partitioned into left and right sides of the main body cabinet 110. However, the storage compartment 115 may alternatively be partitioned into up and down sides of the main body cabinet 110.

The door 120 is rotatably coupled to the main body cabinet 110 and opens/closes the front openings 117*a* and 117*b* of the storage compartment 115. The door 120 includes a freezer compartment door 120*a* opening and closing the front opening 117*a* of the freezer compartment 115*a*, and a refrigerator compartment door 120*b* opening and closing the front opening 117*b* of the refrigerator compartment 115*b*.

The freezer compartment door 120*a* includes a door inner plate 121 and a door outer plate 123 spaced apart from each other with a space S2 to be filled with the heat insulating material therebetween.

The freezer compartment door 120*a* may be provided with a dispenser part (not shown) through which water or ice can be taken out without opening the freezer compartment door 120*a*.

The door inner plate 121 is mounted with an ice making unit 140.

The door outer plate 123 forms the outer appearance of the freezer compartment door 120*a*. The door outer plate 123 includes a front plate 123*a* opposite to the door inner plate 121, and a side chassis 123*b* forming a lateral side between the front plate 123*a* and the door inner plate 121. The space S2 between the door inner plate 121 and the door outer plate 123 is filled with the heat insulating material.

Meanwhile, the freezer compartment door 120*a* may further include a pipe installation part 130 placed in an upper part thereof and forming a space where the water supplying pipe 150 and the discharging pipe 180 are installed. The pipe installation part 130 includes a pipe supporting part 131 which forms a space S3 in the upper part of the freezer compartment door 120*a*, where the water supplying pipe 150 and the discharging pipe 180 are installed, and blocks off the space S2, and a top cover 133 which isolates the water supplying pipe 150 and the discharging pipe 180 installed in the pipe supporting part 131 from the outside.

Here, the pipe supporting part 131 is fastened to the freezer compartment door 120*a* by filling the heat insulating material.

The top cover 133 is detachably coupled to the pipe supporting part 131. In this embodiment, the top cover 133 and the pipe supporting part 131 are coupled by a screw, but the embodiments of the present invention are not limited thereto. Alternatively, the top cover 133 and the pipe supporting part 131 may be coupled by a hook, a rivet, a pin, etc. Further, the top cover 133 may be detachably coupled to the door inner plate 121 or the door outer plate 123 of the freezer compartment door 120*a*.

In the meantime, the freezer compartment door 120*a* is formed with the through part 135 through which the inside and the outside of the freezer compartment 115*a* communicate with each other. In this embodiment, the through part 135 is formed in a direction from the pipe supporting part 131 toward the door inner plate 121 while facing the upper side of the ice making unit 140. Here, the through part 135 is inclined down toward the freezer compartment 115*a*. Thus, the discharging pipe guide 170 is mounted to the through part 135.

The ice making unit 140 is mounted to the door inner plate 121 of the freezer compartment door 120*a*. The ice making unit 140 includes the ice making tray 141 that receives water from the discharging pipe 180 and makes ice, and an ice storage part 143 that stores ice from the ice making tray 141. Further, the ice making unit 140 may include an ice separator (not shown) to separate ice from the ice making tray 141, and an ice crusher (not shown) to crush ice of the ice storage part 143.

The water supplying pipe 150 receives water from the water supplying source 160 and supplies the water to the discharging pipe 180. Here, the water supplying source 160 is a water supplying tank provided in the refrigerator compartment 115*b* and connected to an external water service pipe.

The water supplying pipe 150 includes a first end connected to the water supplying source, and a second end that passes through a lower hinge part (not shown), at which the freezer compartment door 120*a* and the main body cabinet 110 are connected, and the space S2 to be filled with the heat insulating material S2 in the freezer compartment door 120*a* and is then drawn out to the outside of the freezer compartment door 120*a*. In this embodiment, the second end of the water supplying pipe 150 is guided to the space S3 provided in the upper part of the freezer compartment door 120*a* and where the pipe installation part 130 is installed, and then connected to the discharging pipe 180.

The discharging pipe guide 170 is mounted to the through part 135, and includes a guide main body 171 and sealing support parts 175 radially protruding from opposite ends of the guide main body 171.

The guide main body 171 is shaped like a pipe having the hollow part 173, and inclined down toward the upside of the ice making tray 141, similar to the through part 135.

The sealing support parts 175 are supported on the door inner plate 121 of the freezer compartment door 120*a* and a bottom plate of the pipe supporting part 131, respectively, so that the guide main body 171 can be inserted in the through part 135. The sealing support parts 175 not only connect the guide main body 171 to the freezer compartment door 120*a*, but also block the through part 135 so that the heat insulating material can be sealed in the space S2.

The discharging pipe 180 includes a discharging pipe main body 181, and a supporting part 187 connecting the discharging pipe main body 181 to the freezer compartment door 120*a*.

The discharging pipe main body 181 includes an inlet 183 detachably coupled to the water supplying pipe 150 and receiving water from the water supplying pipe 150, and an outlet 185 bent and extended from the inlet 183 and supplying water to the ice making tray 141.

The inlet 183 has a lengthwise direction that is horizontal, like the bottom plate of the pipe supporting part 131.

The water supplying pipe 150 is inserted in the inlet 183. That is, the inlet 183 has a larger inner diameter than the water supplying pipe 150. Thus, water decreases in speed while flowing from the water supplying pipe 150 to the inlet 183.

The inlet 183 may be formed with a screw thread 183*a* on an outer surface at an end thereof facing the water supplying pipe 150. A fastening nut 183*b* is coupled to the screw thread 183*a* of the inlet 183, so that the water supplying pipe 150 and the inlet 183 can be firmly coupled to each other.

The outlet 185 is bent and extended from a free end of the inlet coupled to the water supplying pipe 150 toward the upside of the ice making tray 141. The outlet 185 is bent to be inclined corresponding to the guide main body 171 and passes through the hollow part 173 of the guide main body 171. Thus, the inlet 183 is disposed horizontally and the outlet 185 is bent and extended to prevent residual water from freezing in the discharging pipe 180 when the water supply is discontinued.

In more detail, when water is not supplied, the residual water in the outlet 185 is fully discharged toward the ice making tray 141, due to the incline. Thus, there is no residual water to be frozen even though the outlet 185 is placed in a position where cold air comes out in the freezer compartment.

Meanwhile, when the water supply is discontinued, water remains in the inlet 183 since the inlet 183 is horizontal. However, the inlet 183 is affected by external temperature, so that the residual water cannot freeze even through the cold is transferred through the outlet 185.

The outlet 185 has a larger inner diameter than the inlet 183, so that water can further decrease in speed while flowing from the inlet 183 to the outlet 185. Thus, even though water is rapidly supplied from the water supplying pipe 150, the speed of water is reduced while water passes through the discharging pipe 180, thereby preventing water from colliding with the ice making tray 141 and scattering when supplied to the ice making tray 141.

The supporting part 187 protrudes from a circumferential surface of the discharging pipe main body 181 and is coupled to the pipe supporting part 131. The supporting part 187 is detachably coupled to the pipe supporting part 131. In this embodiment, the supporting part 187 is coupled to the pipe supporting part 131 by a screw. Alternatively, the supporting part 187 and the pipe supporting part 131 are coupled to each other by a pin, a rivet, a hook or the like.

As the discharging pipe 180 is detachably coupled to the water supplying pipe 150 and the pipe supporting part 131, it is possible to separately replace the discharging pipe 180.

Meanwhile, a heater 190 generating heat may be additionally provided in the outlet 185. The heater 190 surrounds an outer surface of the outlet 185. Thus, the outlet 185 is prevented from freezing due to the cold of the freezer compartment 115*a*.

To enhance thermal conductivity between the heater 190 and the outlet 185, the outer surface of the outlet 185 may be wrapped with an aluminum tape or similar metallic material. Alternatively, a lower region 185*a* of the outlet 185, to be surrounded with the heater 190, may be made of a metallic material.

Below, a method of assembling the refrigerator 100 with this configuration according to the first exemplary embodiment of the present invention will be described.

First, the door inner plate 121 and the door outer plate 123 of the freezer compartment door 120*a* are assembled. Then, the pipe supporting part 131 is installed in a top region of the freezer compartment door 120*a*. Here, the through part 135 is provided between the pipe supporting part 131 and the door inner plate 121.

Then, the water supplying pipe 150 passes through the lower hinge part of the freezer compartment door 120*a* and the space S2 to be filled with the heat insulating material, and is drawn out to an upper region of the freezer compartment door 120*a*, that is, to the space S3 in which the pipe installation part 130 will be placed.

Then, the discharging pipe guide 170 is installed in the through part 135, and the heat insulating material is foamed and filled in the space S2. Thus, the filled heat-insulating material causes the water supplying pipe 150 and the discharging pipe guide 170 to be fastened to the inside of the freezer compartment door 120*a*.

The water supplying pipe 150 is inserted in the discharging pipe 180 and the fastening nut 183*b* is put on the screw thread 183*a* of the discharging pipe 180, thereby coupling the water supplying pipe 150 and the discharging pipe 180 with each other.

The heater 190 is installed on the outlet 185 of the discharging pipe 180, and the outlet 185 with the heater 190 is inserted in the hollow 173 of the guide main body 171. Then, the supporting part 187 of the discharging pipe 180 is coupled to the pipe supporting part 131.

To cover the water supplying pipe 150 and the discharging pipe 180 accommodated in the space S3 of the pipe supporting part 131, the top cover 133 is coupled to the pipe supporting part 131.

Below, a method of replacing the discharging pipe 180 in the refrigerator 100 with this configuration according to the first exemplary embodiment of the present invention will be described.

First, the top cover 133 is separated from the pipe supporting part 131.

Then, the supporting part 187 of the discharging pipe 180 is separated from the pipe supporting part 131.

The fastening nut 183*b* is separated from the inlet 183, and the water supplying pipe 150 is pulled out from the discharging pipe 180. The discharging pipe 180 is drawn out from the guide main body 171 so that the water supplying pipe 160 can be independently separated.

Here, a new discharging pipe 180 will be assembled in order reverse to the above disassembling order.

Figure 5:
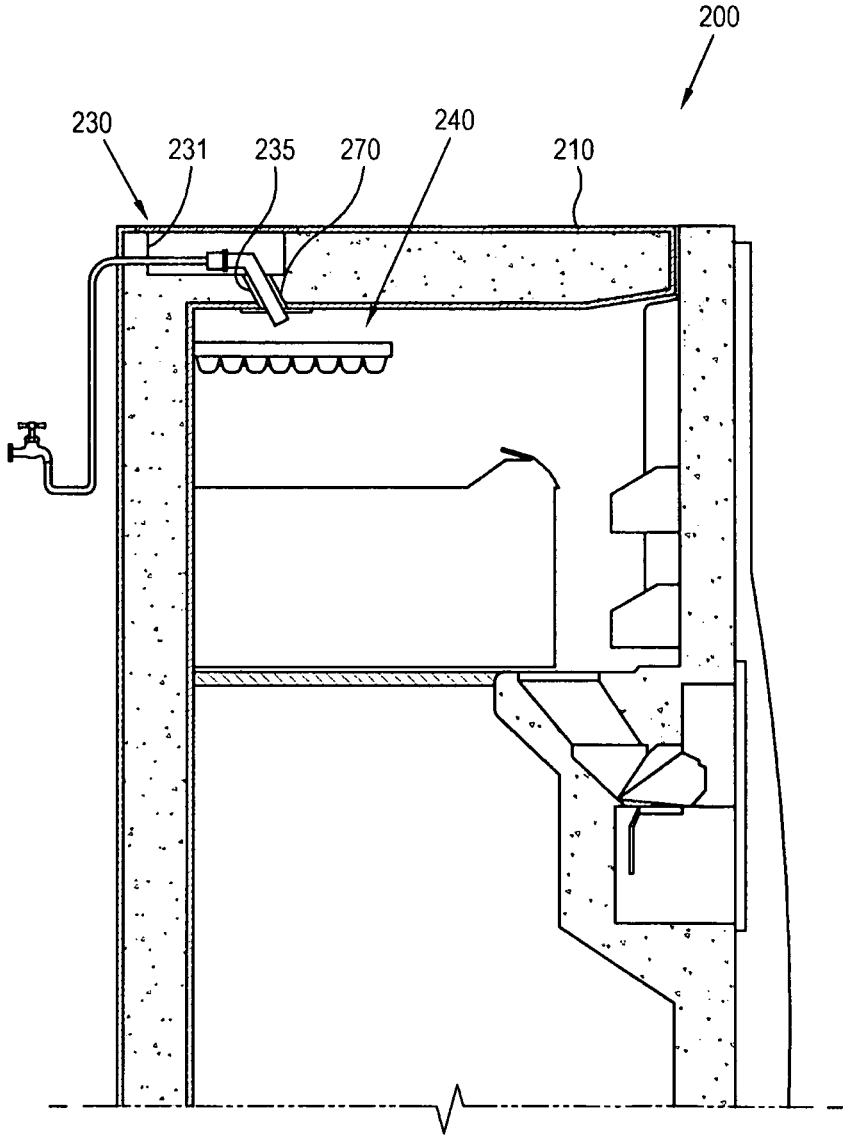
FIG. 5 is a lateral section view showing a schematic configuration of a refrigerator according to a second exemplary embodiment of the present invention.

FIG. 5 shows a refrigerator 200 according to a second exemplary embodiment of the present invention. While the ice making unit 140 in the first exemplary embodiment is mounted to the freezer compartment door 120*a*, an ice making unit 240 in the second exemplary embodiment is mounted to the freezer compartment 115*a*. In the second exemplary embodiment, detailed descriptions of elements will be omitted, and difference from the first exemplary embodiment will be chiefly described.

In this embodiment, the ice making unit 240 of the refrigerator 200 is placed in the freezer compartment 115*a*.

A pipe installation part 230 is placed in an upper region of a main body cabinet 210, and a water supplying pipe 150 is drawn out to the pipe installation part 230 via a space S1 to be filled with the heat insulating material, or directly connected from the outside to the pipe installation part 230.

A through part 235 is formed in the upper region of the main body cabinet 210 so that the outside and the inside of the freezer compartment 115 can communicate with each other. A discharging pipe guide 210 is mounted to the through part 235. The through part 235 from the pipe supporting part 231 may be formed by penetrating a rear wall or a lateral wall of the freezer compartment 115*a*.

In the foregoing embodiment, the ice making unit 140, 240 is mounted to the freezer compartment door 120*a* or the freezer compartment 115*a*, but not limited thereto. Alternatively, the ice making unit may be mounted to the refrigerator compartment door 120*b* or the refrigerator compartment 115*b* separately provided with an ice making compartment (not shown).

As described above, the present invention provides a refrigerator of which a discharging pipe supplying water to an ice making tray is replaceable without replacing a door.

Although a few embodiments have been shown and described, it would be appreciated by those skilled in the art that changes may be made in these embodiments without departing from the principles and spirit of the invention, the scope of which is defined in the claims and their equivalents.

What is claimed is:

1. A refrigerator comprising:

a storage compartment;

an ice making tray mounted in an inside wall of a door;

a water supplying pipe which receives water from a water supplying source;

a discharging pipe installed in an outside region of the storage compartment and comprising:

a first end part detachably coupled to the water supplying pipe, and a second end part detachably coupled to a through part through which the outside region of the storage compartment communicates with an inside region of the storage compartment, the second end part disposed above the ice making tray to discharge water toward the ice making tray; and a discharging pipe guide comprising a hollow part to receive the second end part and is installed in the through part, the hollow part extending from the one end of the through part to the inside region of the storage compartment.

2. The refrigerator according to claim 1, wherein the discharging pipe guide is inclined down toward the upside of the ice making tray.

3. The refrigerator according to claim 1, wherein the door comprises:

a door inner plate and a door outer plate spaced apart from each other and defining a first space, and a heat insulating material to fill the space; and a pipe installation part defining a second space where the water supplying pipe and the discharging pipe are installed in an upper region of the door inner plate and the door outer plate.

4. The refrigerator according to claim 3, wherein the discharging pipe is detachably coupled to the pipe installation part.

5. The refrigerator according to claim 4, wherein the discharging pipe has a larger inner diameter than the water supplying pipe.

6. The refrigerator according to claim 4, wherein the discharging pipe comprises an inlet disposed horizontally and connected to the water supplying pipe; and an outlet bent and extended from the inlet and inserted in the hollow part of the discharging pipe guide.

7. The refrigerator according to claim 6, wherein the discharging pipe comprises a supporting part supporting the inlet and the outlet to the door.

8. The refrigerator according to claim 6, wherein the outlet has a larger inner diameter than the inlet.

9. The refrigerator according to claim 1, further comprising a heater supplying heat to the discharging pipe.

10. A refrigerator comprising: a storage compartment having an opening; a door provided to the opening of the storage compartment; an ice making tray mounted to an interior wall of the door; a discharging pipe installed in an outside region of the storage compartment and comprising: a first end part detachably coupled to a water supplying pipe which receives water from a water supplying source, and , a second end part detachably coupled to one end of a through part forming a passage through which the outside region of the storage compartment communicates with an inside region of the storage compartment, the second end part disposed above the ice making tray to discharge water toward the ice making tray; and a discharging pipe guide which comprises a hollow part to receive the second end part and is installed in the through part, the hollow part extending from the one end of the through part to the inside region of the storage compartment.

11. A refrigerator comprising: a storage compartment having an opening; and a door provided to the opening of the storage compartment, the door comprising: an ice making tray mounted to an interior wall of the door; a water supplying pipe having a coupling end, which receives Water from a water supplying source through a hinge connecting the door to the storage compartment; a discharging pipe comprising: a first end part detachably coupled to the coupling end of the water supplying pipe, and a second end part detachably coupled to one end of a through part forming a passage through which an outside region of the storage compartment communicates with an inside region of the storage compartment, the second end part disposed above the ice making tray to discharge water toward the ice making tray; a discharging pipe guide which comprises a hollow part to receive the second end part and is installed in the through part, the hollow part extending from the one end of the through part to the inside region of the storage compartment; an inner plate and an outer plate spaced apart from each other and defining a first space filled with a heat insulating material; and a pipe installation part defining a second space in which the discharging pipe is detachably coupled to the water supplying pipe and the through part, wherein the second space of the pipe installation part and the hollow part of the discharging pipe guide are void of the heat insulating material.

* * * * *